US005400587A

United States Patent [19]

Keller et al.

[11] Patent Number: 5,400,587

[45] Date of Patent: Mar. 28, 1995

[54] GAS TURBINE ANNULAR COMBUSTION CHAMBER HAVING RADIALLY DISPLACED GROUPS OF OPPOSITELY SWIRLING BURNERS.

[75] Inventors: Jakob Keller, Redmond, Wash.; Thomas Sattelmayer, Mandach; Peter Senior, Mellingen, both of Switzerland

[73] Assignee: Asea Brown Boveri Ltd., Baden, Switzerland

[21] Appl. No.: 202,687

[22] Filed: Feb. 25, 1994

Related U.S. Application Data

[63] Continuation of Ser. No. 974,523, Nov. 12, 1992, abandoned.

[30] Foreign Application Priority Data

Nov. 13, 1991 [CH] Switzerland ..... 3308/91

[51] Int. Cl.[6] ..... F23R 3/12; F23R 3/50

[52] U.S. Cl. ..... 60/39.36; 60/748

[58] Field of Search ..... 60/39.06, 39.36, 39.37, 60/746, 747, 748

[56] References Cited

U.S. PATENT DOCUMENTS

| | | | |
|---|---|---|---|
| 3,714,778 | 2/1973 | Howald | 60/746 |
| 4,100,733 | 7/1978 | Striebel et al. . | |
| 4,455,840 | 6/1984 | Matt et al. | 60/737 |
| 4,991,398 | 2/1991 | Clark et al. | 60/748 |
| 5,081,844 | 1/1992 | Keller et al. | 60/39.27 |

FOREIGN PATENT DOCUMENTS

| | | |
|---|---|---|
| 0378505 | 7/1990 | European Pat. Off. . |
| 0387532 | 9/1990 | European Pat. Off. . |
| 0401529 | 12/1990 | European Pat. Off. . |
| 2406726 | 5/1979 | France . |
| 3837635 | 5/1990 | Germany . |
| 2015651 | 9/1979 | United Kingdom . |

OTHER PUBLICATIONS

Lefebvre, Arthur H. *Gas Turbine Combustion*. New York, N.Y.: McGraw-Hill, 1983. pp. 12, 22, 23, 25, and 492.

*Primary Examiner*—Timothy S. Thorpe

*Attorney, Agent, or Firm*—Burns, Doane, Swecker & Mathis

[57] ABSTRACT

In a gas turbine combustion chamber which surrounds the rotor as an annulus and therefore has the shape of an annular combustion chamber, the front wall (10) is equipped with a number of burners whose ends occupy a uniform plane. These burners form a double ring (10*b*, 10*c*) on the front wall (10). In each ring, the same direction of rotation is present in the burners and this is opposite to the adjacent ring. In addition, two burners at a time are alternately displaced outwards and inwards in each ring in order to achieve a favorable flow field for combustion. The number of burners on the front wall (10) is divided into a larger quantity of piloting burners (A1, A2 ) and a smaller quantity of piloted burners (B1, B2).

5 Claims, 5 Drawing Sheets

GAS TURBINE ANNULAR COMBUSTION CHAMBER HAVING RADIALLY DISPLACED GROUPS OF OPPOSITELY SWIRLING BURNERS.

This application is a continuation of application Ser. No. 07/974,523, filed Nov. 12, 1992, now abandoned.

BACKGROUND OF THE INVENTION

1. Field of the Invention

The present invention concerns a combustion chamber in accordance with the preamble to claim 1. It also concerns a method for operating such a combustion chamber.

2. Discussion of Background

The transition from conventional tubular combustion chambers to annular combustion chambers undoubtedly introduces advantages, at least with respect to space, because such combustion chambers surround the central part of the rotor of the gas turbine in a regular and annular manner. With respect to the operating procedure, however, this transition has not proved optimum to the desired extent, as far as can be seen from the state of the art. It is not possible to discern an intelligent operating procedure for gaseous fuels whose flows are available as a function of the particular operating point, particularly if it is assumed that minimized pollutant emissions are to be achieved. In other words, the space advantages which the annular combustion chamber undoubtedly offers must not be obtained at the expense of an increase in the pollutant emissions from the combustion.

SUMMARY OF THE INVENTION

Accordingly, one object of the invention is to provide aid in this respect: by proposing, as specified in the claims, a novel procedure which permits the pollutant emissions to be minimized in a method of the type quoted at the beginning.

The essential advantage of the invention may be seen in the fact that an optimized operating procedure can be carried out independent of the size of the annular combustion chamber and the number of burners employed in it.

A further essential advantage of the invention may be seen in the fact that water or steam is often injected into the flame in order to increase the power of a gas turbine. In pure premixing burners, this often leads to the flame being extinguished or to vibration problems. In the arrangement selected, an increasing proportion of fuel is injected through a head stage in the burners with increasing water or steam quantity in such a way as to prevent the flame from being extinguished and to prevent vibration problems occurring.

A further essential advantage of the invention lies in the favorable overall behavior of the burners both during ignition and during operation. The burners themselves are located at the head of the annular combustion chamber and form, in principle, a double ring on the front wall. Two burners at a time are alternatively displaced outwards and inwards in order to achieve a favorable flow field for combustion. The burners in each ring have the same direction of rotation and have the opposite direction of rotation relative to the burners in the other ring, all this being done in order to obtain a strong transverse flow along the combustion chamber walls and in the center. As far as the burners themselves are concerned, they are divided into piloting and piloted burners, the latter being present in a smaller number than the former. The position of the piloted burners is preferably selected in such a way that they are satisfactorily surrounded by the piloting burners; this leads to good burn-out in the operational range in which the piloted burners cannot generate their own flames and, instead, only inject a very weak mixture into the hot exhaust gases of the piloting burners.

Advantageous and useful further developments of the solution to the object of the invention are specified in the further dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
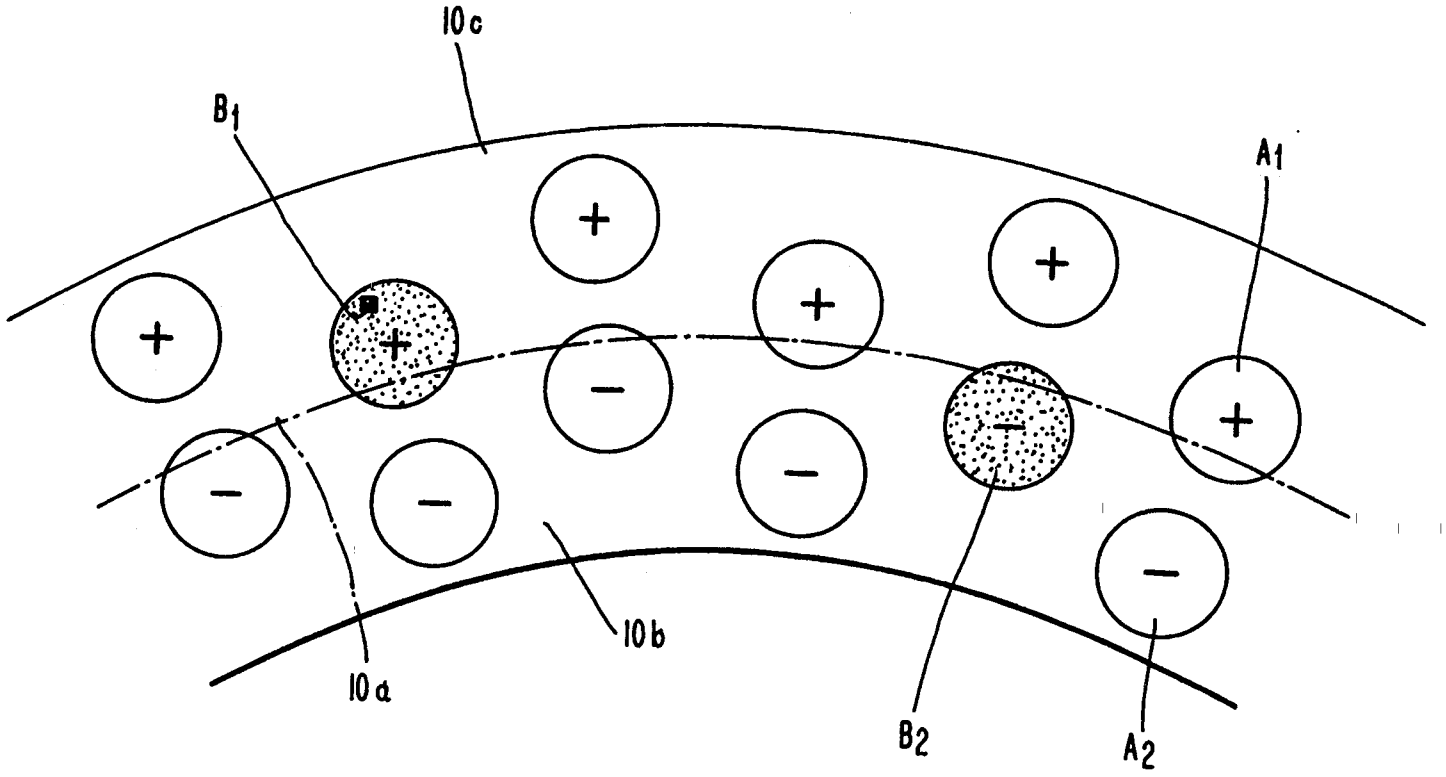
FIG. 1 shows a diagrammatic sector part of the front wall of an annular combustion cheer.

Referring now to the drawings, wherein like reference numerals and letters designate identical or corresponding parts throughout the several views, wherein all the elements not directly necessary for understanding the invention are omitted and wherein the flow direction of the media is indicated by arrows, FIG. 1 shows a sector part of a front wall of an annular combustion chamber. Reference should be made to EP-A1-0 401 529 for better understanding of the further embodiment of the annular combustion chamber. The annular combustion chamber has a series of burners whose number depends on the size of the machine and the size of the burners. The main stages, whose embodiments are preferably configured from the diagrammatic representation of FIG. 4, of all the burners are connected to a fuel supply. The head stages are collected in two groups and the burner proportion per group is matched, fundamentally, to the particular machine. The two groups differ from one another in that one group consists of piloting burners A1, A2 and the other group consists of piloted burners B1, B2. Fundamentally, the number of piloting burners A1, A2 is much greater than the number of piloted burners B1, B2. The switching procedure of the annular combustion chamber considered is based on the fact that the compressor of the gas turbine group is equipped with variable inlet guide vane rows so that the air flow can be reduced by at least 15% relative to the full load air flow. When the gas turbine is being started and run up, the fuel is distributed to the head stages, for which reference should be made to FIGS. 4–7, of the piloting burners A1, A2. The setting of the inlet guide vane row is, in this connection, immaterial. The inlet guide vane row must be closed, at the latest, when synchronization with the grid has taken place. The inlet guide, vane row remains closed up to a load of approximately 65–80%. Beyond this point, it is opened continuously. With increasing load, the fuel flow to the piloting burners A1, A2 is increasingly supplied to the main stage. At some 40–45% load, the head stages are substantially out of operation and the piloting burners A1, A2 are operated in pure premixing mode. Between 40–45% and 65–80% machine power, the fuel flow to the piloting burners A1, A2 remains substantially unaltered. The power is increased by increasing the fuel flow to the main stages of the piloted burners B1, B2. As soon as the fuel flow to all the burners is the same, the operating point is also reached from which the annular combustion chamber is operated with all the burners in purely pre-mixed operation. Beyond this point, the fuel and air flows are increased substantially in proportion in order to keep the equivalence ratio at an optimum value. The burners—both piloting and piloted—form, in principle, a double ring **10*b*, 10*c* on the front wall 10 of the annular combustion chamber, as expressed by the line of symmetry 10*a*. However, two burners at a time are displaced alternately outwards and inwards in order to obtain a favorable flow field for combustion. The burners in each ring have the same direction of rotation, which is opposite to that in the adjacent ring, as is symbolized by the plus and minus signs in the burners. This configuration causes a strong flow along the combustion chamber walls and in the center. The position of the piloted burners B1, B2 is important here; they are surrounded as well as possible by the other burners, i.e. by the piloting burners A1, A2. This leads to good burn-out in the operating range in which the piloted burners B1, B2 cannot generate their own flame—as is the case in the operating range between 40–45% and 65–80%—and in which, instead, they only inject a very weak mixture into the hot exhaust gases of the piloting burners A1, A2**.

Figure 2:
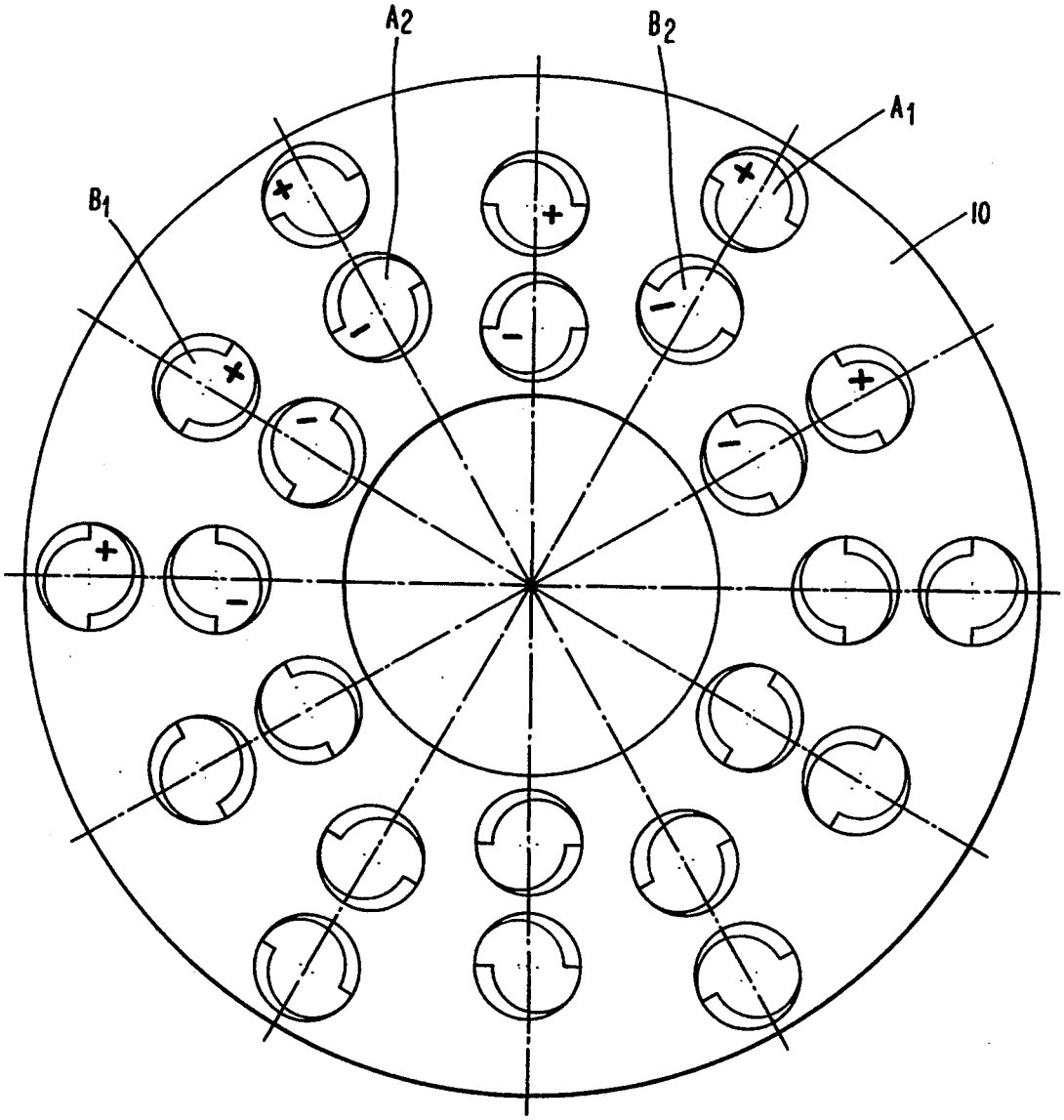
FIG. 2 shows a front wall of an annular combustion chamber equipped with burners, the diagrammatic reproduction of the burners corresponding to the burners of the embodiment of FIGS. 4–7.

FIG. 2 shows the complete front wall 10 of the annular combustion chamber, the piloted burners B1, B2 making up only 1/6 of the total quantity. A proportion of 5/6 therefore applies to the piloting burners A1, A2. This division represents a preferred variant. Other divisions can certainly be conceived depending on the type of annular combustion chamber.

Figure 3:
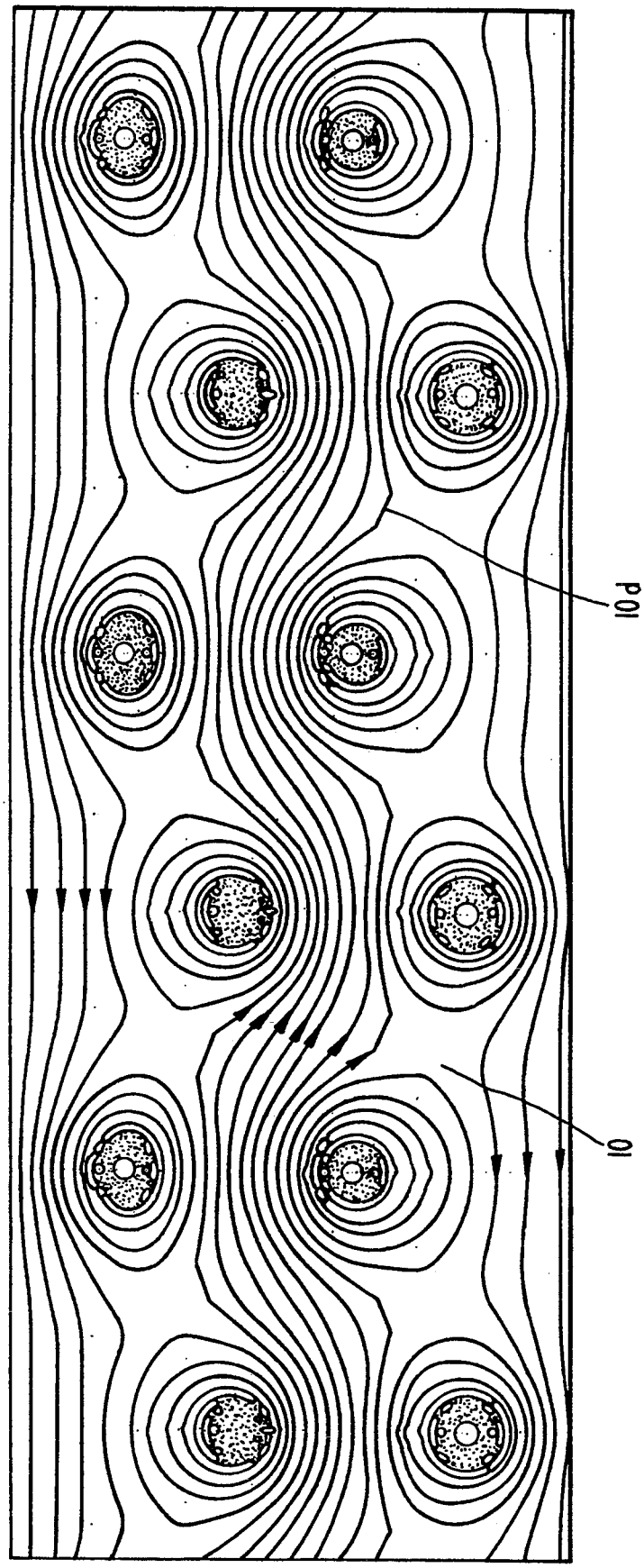
FIG. 3 shows a simulated reproduction of the streamlines on the front wall.

FIG. 3 shows the streamlines **10*d* forming on the front wall 10 during operation, as determined by test. The configuration of the streamlines 10*d* has a major effect on the overall behavior of the combustion chamber, especially during the ignition procedure. The closeness of the streamlines 10*d* indicates a high velocity and this high velocity, which becomes established particularly well—as may be seen—in the region of the line of symmetry (see FIG. 1**), ensures that the ignition can be transmitted from the piloting burners to the piloted burners.

Figure 4:
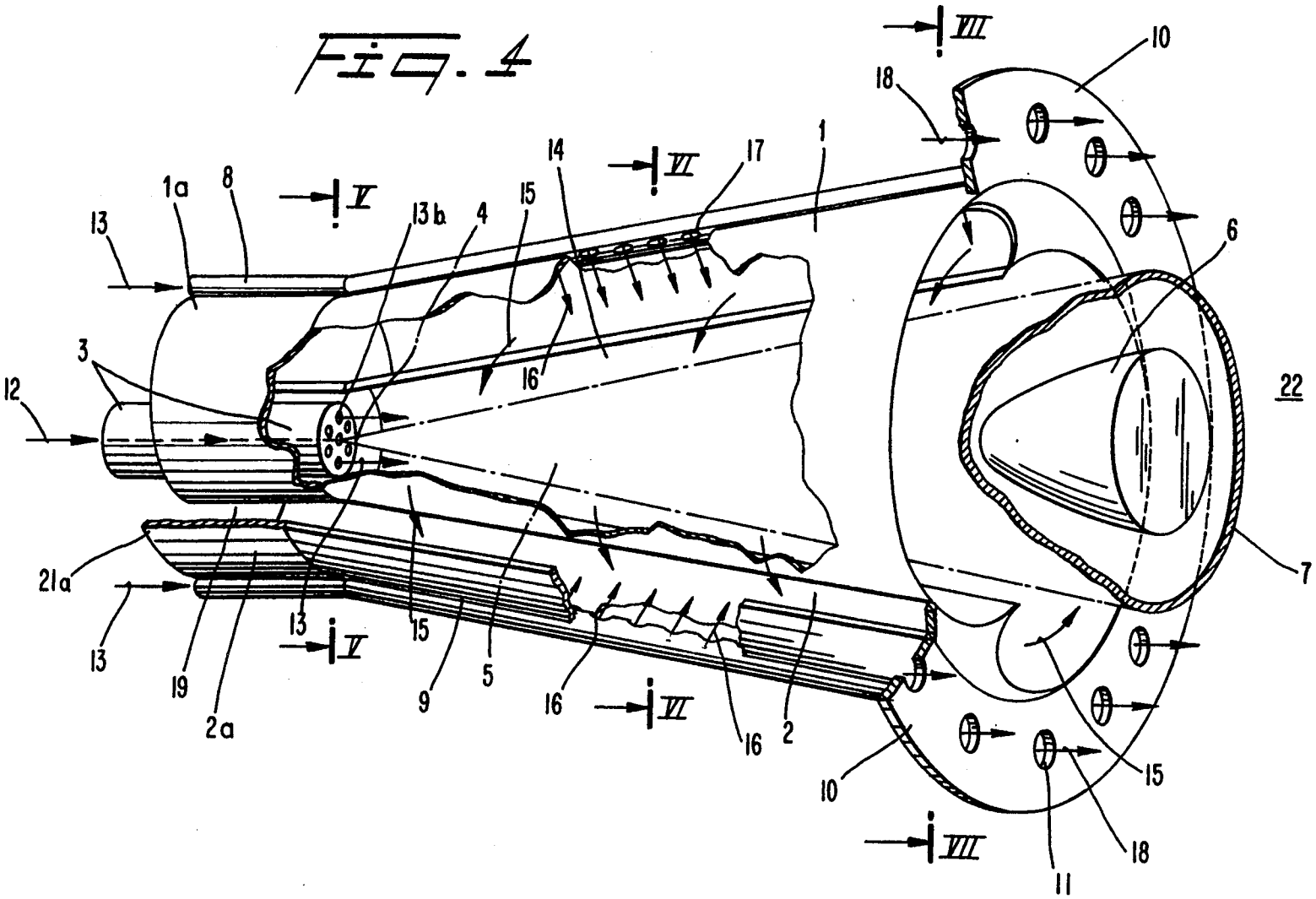
FIG. 4 shows a burner in a perspective view.
Figure 5:
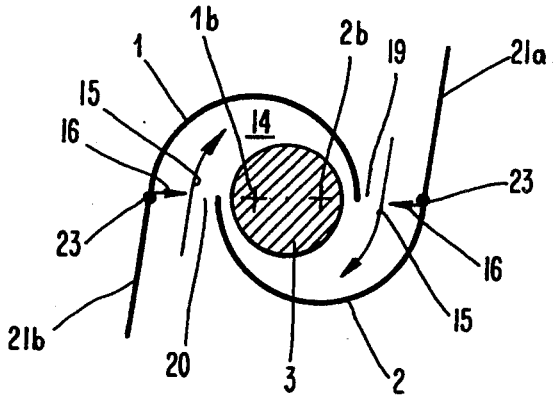
FIGS. 5–7 show corresponding sections through the planes V—V (FIG. 5), VI—VI (FIG. 6) and VII—VII (FIG. 7), these sections only reproducing a diagrammatic, simplified representation of the burner of FIG. 4.
Figure 6:
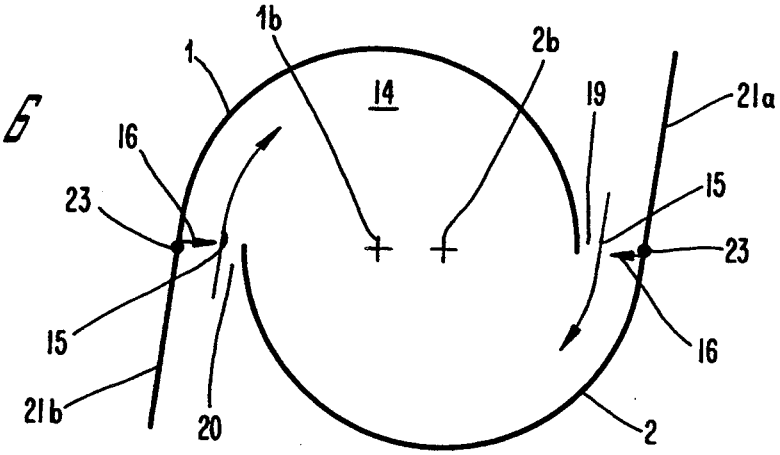
Figure 7:
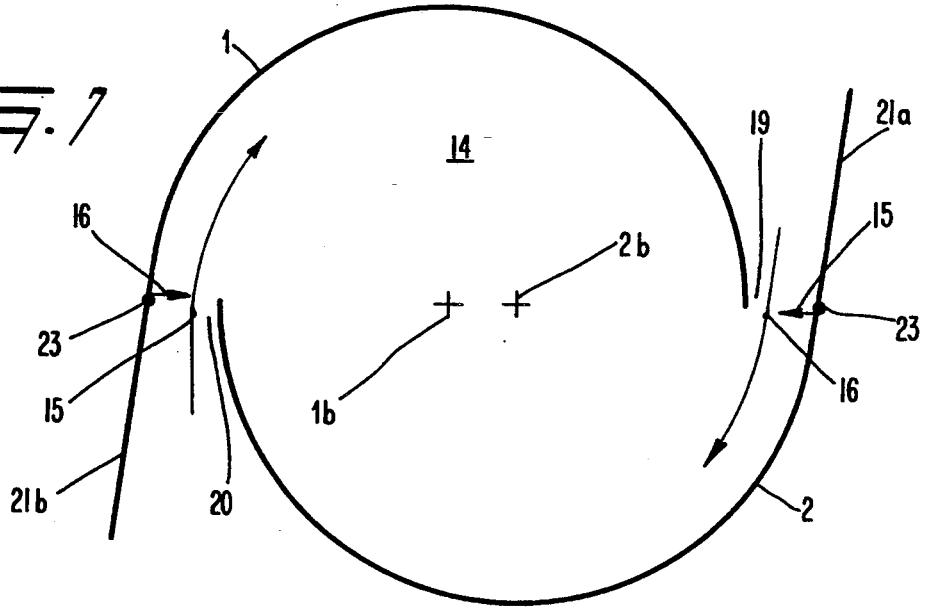

It is advantageous for better understanding of the construction of the burner to consider the individual sections from FIG. 4, which are shown in FIGS. 5–7, at the same time as FIG. 4. Furthermore, in order to make FIG. 4 as comprehensible as possible, the guide plates **21*a*, 21*b* shown diagrammatically in FIGS. 5–7 are only indicated in FIG. 4. In the description of FIG. 4 below, reference is made as required to FIGS. 5–7**.

FIG. 4 shows the burner, which has an intrinsically integrated premixing zone, in perspective view. The burner itself consists of two half hollow partial conical bodies 1, 2 which are located one upon the other and whose longitudinal axes of symmetry are radially offset relative to one another. This offset of the respective longitudinal axes of symmetry **1*b*, 2*b* (see FIGS. 5–7) relative to one another frees respective tangential air inlet slots 19, 20 (see FIGS. 5–7) on both sides of the partial conical bodies 1, 2 so that the flow is in opposite directions and combustion air 15 flows through them into the internal space of the burner, i.e. into the hollow conical space 14 formed by the two partial conical bodies 1, 2. The conical shape of the partial conical bodies 1, 2 shown has a certain fixed angle in the flow direction. The partial conical bodies 1, 2 can, of course, have a progressive or degressive conical inclination in the flow direction. The two embodiments last mentioned are not included in the drawing because they are immediately obvious. Which shape is preferred in the end depends essentially on the particular combustion parameters specified. The two partial conical bodies 1, 2 each have a cylindrical initial part 1*a*, 2*a* which forms a continuation of the partial conical bodies 1, 2 so that the tangential inlet slots 19, 20 are also present and extend over the complete length of the burner. The burner can, of course, be made purely conical, i.e. without a cylindrical initial part 1*a*, 2*a* and, in addition, this initial part does not have to be cylindrical. A nozzle 3, the so-called head stage, is accommodated in this cylindrically configured initial part 1*a*, 2*a*. The fuel supply to this head stage consists of a central fuel injection 4 of a liquid fuel 12, preferably oil, and a substantially coaxial fuel injection of a gaseous fuel 13. The injection of the gaseous fuel 13 takes place by means of a series of injection openings 13*a* which are arranged in the form of a ring around the central fuel injection 4. In general, the said fuel injections can involve air-supported injection or pressure atomization. The fuel injections therefore take place approximately in the region of the narrowest cross-section of the conical hollow space 14 formed by the two partial conical bodies 1, 2. Each of the two partial conical bodies 1, 2 has a fuel conduit 8, 9 in the region of the tangential air inlet slot 19, 20 and these slots are provided on their longitudinal sides with a number of openings 17 through which a gaseous and/or liquid fuel 13 is injected, it being preferable to use gas. This fuel mixes with the combustion air 15 flowing through the tangential inlet slots 19, 20 into the hollow conical space 14, as symbolized by the arrow 16. These fuel conduits 8, 9, which form the so-called main stage of the burner, are preferably placed at the end of the tangential inlet flow before entry into the hollow conical space 14 in order to achieve optimum air/fuel mixing before the mixture flows into the hollow conical space 14. Mixed operation is, of course, possible with both fuel supplies, i.e. one via the central nozzle 3 and one via the fuel conduits 8, 9. At the combustion space end 22, the outlet opening of the burner merges into a front wall 10 in which there are a number of holes 11. These are used for cooling the burner end surface. Other cooling techniques are also conceivable. The liquid fuel 12 flowing through the nozzle 3 is injected with an acute angle into the hollow conical space 14 in such a way that a spray pattern which is as homogeneously conical as possible appears at the burner outlet plane. This is only possible if the inner walls of the partial conical bodies 1, 2 are not wetted by the fuel injection 4. For this purpose, the conical profile 5 consisting of a liquid fuel is surrounded by the tangentially entering combustion air 15 and, if necessary, by a further, axially introduced, combustion air flow which is not visible in the figure. The concentration of the liquid fuel 12 is continuously reduced in the axial direction by the admixture of the combustion air flows. If a gaseous fuel 13 is introduced via the fuel conduits 8, 9, for example, mixing with the combustion air 15 takes place directly in the region of the air inlet slots 19, 20. When a liquid fuel is employed, the injection is correspondingly displaced. Minimized pollutant emission figures can then be always achieved if complete evaporation takes place before entry to the combustion zone. The same also applies to near-stoichiometric operation where the excess air is replaced by recirculated exhaust gas. In the configuration of the partial conical bodies 1, 2, tight limits have to be applied to the conical angle and the width of the tangential air inlet slots 19, 20 so as to produce the desired flow field of the air with the reverse flow zone 6 in the region of the burner outlet opening. In general, it may be stated that making the air inlet slots 19, 20 smaller displaces the reverse flow :zone 6 further upstream, bringing about earlier ignition of the air fuel mixture. In this respect, it should be noted that the position of the reverse flow zone 6, once fixed, is intrinsically stable because the swirl increases in the direction of flow in the region of the conical shape of the burner. The axial velocity of the mixture can also be influenced by the previously mentioned supply of an axial flow of combustion air. The construction of the burner is outstandingly suitable for changing the size of the tangential air inlet slots 19, 20 at a given overall length of the burner. This is achieved by displacing the partial conical bodies 1, 2 towards or away from one another so that the distance between the two central axes 1*b*, 2*b* is reduced or increased, the gap size of the tangential air inlet slots 19, 20 also changing correspondingly—as exemplified particularly well by FIGS. 5–7. The partial conical bodies 1, 2 can, of course, be displaced towards one another in a different plane and can even be driven towards an overlap. It is, in fact, also possible to push the two partial conical bodies 1, 2 spirally into one another by a rotational motion in opposite directions or to displace them axially relative to one another in the longitudinal direction. Using simple arrangements, it is therefore possible to vary the shape and size of the tangential air inlet slots 19, 20** arbitrarily so that the burner can be individually matched, within a certain operational band width, without changing its overall length.

The geometric configuration of the guide plates **21*a*, 21*b* may be seen in FIGS. 5–7. They fulfil flow inlet functions by extending, in accordance with their length, the respective end of the partial conical bodies 1, 2 in the incident flow direction of the combustion air 15. The ducting of the combustion air 15 into the hollow conical space 14 can be optimized by opening or closing the guide plates 21*a*, 21*b* about a center of rotation 23 placed in the region of the inlet into the hollow conical space 14. This is particularly necessary when the original gap size of the tangential air inlet slots 19, 20** has to be changed. The burner can, of course, also be operated without guide plates or, alternatively, other aids can be provided for this purpose.

Obviously, numerous modifications and variations of the present invention are possible in light of the above teachings. It is therefore to be understood that within the scope of the appended claims, the invention may be practised otherwise than as specifically described herein.

What is claimed as new and desired to be secured by letters patent of the United States is:

1. An annular combustion chamber of a gas turbine, comprising:

an inlet front wall;

a plurality of premixing burners arranged on the front wall so that outlets of the burners are on a single plane, all of the burners being positioned in circumferentially adjacent groups of at least two burners, the burners in each group being radially aligned on the front wall, each group including at least an inner burner and an outer burner, wherein the burners are configured to produce a swirl having a direction of rotation, the inner burners having one swirl direction, the outer burners having a swirl of one direction opposite to that of the inner burners, wherein adjacent groups of burners are alternately positioned radially outward and radially inward relative to each other; and means for operating the burners as one of piloting burners and piloted burners.

2. The combustion chamber as claimed in claim 1, wherein the means for operating the burners operates the burners in the ratio of 5/6 piloting burners and 1/6 piloted burners.

3. The combustion chamber as claimed in claim 1, wherein the premixing burner comprises two hollow conical partial bodies which are positioned one upon the other to form a hollow conical space longitudinal axes of symmetry of each of the conical partial bodies being offset relative to one another so that tangential air inlet slots are formed on opposing sides of the conical space for a tangential flow of combustion air into the conical space, wherein at least one nozzle configured as a head stage for the injection of at least one of a liquid and a gaseous fuel is placed in the hollow conical space and wherein a fuel supply stage designed as a main stage is arranged for introducing a gaseous fuel in the region of the tangential air inlet slots.

4. The annular combustion chamber as claimed in claim 1, wherein means for operating the burners as one of piloting burners and piloted burners comprises means for controlling a flow of fuel to the burners.

5. The annular combustion chamber as claimed in claim 1, wherein the burners operated as piloted burners are located adjacent only to burners operated as piloting burners.

* * * * *